United States Patent [19]

Kettlestrings

[11] Patent Number: 4,697,534

[45] Date of Patent: Oct. 6, 1987

[54] FABRICATED SPAR ADAPTER SAILING RIG

[76] Inventor: John S. Kettlestrings, 2235 Stonegate La., Wheaton, Ill. 60187

[21] Appl. No.: 755,788

[22] Filed: Jul. 17, 1985

[51] Int. Cl.[4] ..... B63B 15/00

[52] U.S. Cl. ..... 114/90; 114/97; 114/102; 114/39

[58] Field of Search ..... 114/90, 91, 93, 97, 114/98, 99, 102, 103, 39, 39.1, 39.2

[56] References Cited

U.S. PATENT DOCUMENTS

| | | | |
|---|---|---|---|
| 75,671 | 3/1868 | Dowling | 114/93 |
| 3,142,282 | 7/1964 | Nichols | 114/102 |
| 3,598,075 | 8/1971 | Kenney | 114/102 X |
| 3,656,444 | 4/1972 | Kratz | 114/39 |
| 3,802,371 | 4/1974 | Jastrab | 114/102 |
| 3,889,620 | 6/1975 | Dorland | 114/102 X |
| 4,077,345 | 3/1978 | Gurley | 114/39 |
| 4,512,276 | 4/1985 | Hamann | 114/39.2 |
| 4,558,655 | 12/1985 | Debarge | 114/93 X |

FOREIGN PATENT DOCUMENTS

| | | | |
|---|---|---|---|
| 7807777 | 1/1980 | Netherlands | 114/93 |
| 2063806 | 6/1981 | United Kingdom | 114/90 |
| 783123 | 11/1980 | U.S.S.R. | 114/102 |

*Primary Examiner*—Galen Barefoot
*Assistant Examiner*—Paul E. Salmon
*Attorney, Agent, or Firm*—Hill, Van Santen, Steadman & Simpson

[57] ABSTRACT

A sailing vessel is provided with an improved rig which utilizes a fabricated adapter having a downwardly depending leg rotatably held in the hull of the boat and having a first forwardly angled arm for carrying a rigid mast spar and a rearwardly angled arm carrying a rigid boom spar. The sail has a curved leading edge attachable to the mast spar and a foot attachable to the boom spar which causes the mast and boom spars to be bowed toward each other and under continuous but adjustable tension resulting in a taut sail. Since the mast spar is forward of the center of rotation of the rig. The center of effort of the sail is positioned closely adjacent, but slightly downwind of the center of rotation of the rig resulting in easier handling of the sail, greater rig efficiency and improved balance of the vessel.

15 Claims, 18 Drawing Figures

FABRICATED SPAR ADAPTER SAILING RIG

BACKGROUND OF THE INVENTION

1. Field of the Invention

The present invention relates to wind powered vessel rigs and more particularly to a rig utilizing a fabricated mast and boom spar adapter.

2. Description of the Prior Art

Many different types of sailboat rigs are known in the art and most rigs include a vertical mast and a horizontal boom for carrying the main sail. The mast and boom spars and rigid but attached to each other in a non-rigid manner. The sail is attached to the mast by threading a forward or luff edge of the sail in a slot in the mast or by sleeving the sail over the mast spar. The bottom edge or foot of the sail is often times captured in the boom in a similar manner although it may be secured to the boom by a line at the clew of the sail. Masts are stepped to the deck, to the sole or keel or through the deck to the sole in a fixed manner either with shrouds or through a tubular mast holder. Some masts rotate and some masts that rotate have a boom spar attached so that boom travel causes the mast to rotate.

Board sailers (windsurfers) have mast/sail rigs attached to the board by a flexible rubber socket requiring a person to hold the rig upright for the purpose of engaging the wind.

Problems associated with many conventionally rigged sailboats relate to the control lines or sheets required to maintain control of the rig, clearance problems due to swinging of the boom across the cockpit area, efficiency of the sail's effort to the movement of the boat and the relationship of the effort of the wind on the rig to the balance of the vessel.

SUMMARY OF THE INVENTION

The present invention avoids some of the problems known in conventional rigging by providing a fabricated adapter for attachment of a mast spar and a boom spar to hold the sail in place. When a sail of appropriate shape is fitted and attached to the spars, the mast and boom spars are pulled towards each other by the sail but, due to their stiffness and resiliency resist with a spring force thus creating a tension between the mast spar and boom leg, resulting in a tensioning of the sail.

Due to the efficiency of the configuration caused by this spar adapter and its placement in the vessel, the center of effort of the rig is in the proximity of the center of rotation of the rig. This improves the sailing characteristics of the vessel while reducing required sheeting tension.

The rig contemplated by the present invention provides several advantages over currently known rigs. The efficiency of such a rig allows the employment of a smaller sail which lowers the righting moment resulting in flatter sailing. In addition, the rig on a vessel renders the vessel essentially self-tending. The balanced rig of the present invention also eliminates the need for multiple block sheeting and eliminates harsh rig movements during intentional or accidental jibes. Sail twist is also greatly reduced.

As an added embodiment of the invention, two mast adapters can be utilized to provide a double rig that can either be locked together and sheeted and set as one sail or can be separated at will and sheeted independently. This provides additional sail area for increased speed and efficiency. The double rig can be sailed with only one sail when desired. This reduces the sail area by 50% which is excellent for instruction purposes, for children or for heavy air.

There are two basic principles utilized in the sail rig of the present invention. A structure is fabricated to accept the mast spar heel and the boom spar heel in a completely fixed and rigid relationship to each other. The structure attaches to the vessel by means of an extension into a receptacle in the vessel, generally vertical, that allows rotation of the fabricated structure.

The mounting extension described, in one embodiment of the invention, is offset rearward of the mast spar heel and in another embodiment, the mast spar heel receptacle portion of the fabricated adapter is angled forward of the mounting extension. Thus, in either case, the sail is partially forward and partially behind the center of rotation of the fabricated adapter. When the cloth or plastic sail is secured, both the mast and boom spars are bent in a bow-like manner towards each other. The boom and mast spars act as spring legs tensioning the sail. The entire rig is, by its very nature, locked together and stays that way during all normal sailing situations. The centerline of effort of the sail and rig is moved closer to the center line of rotation of the rig thereby "balancing" the effect of the wind on the sail. The degree of tension in the rig can be controlled by easing or tensioning the line securing the sail's clew to the boom spar.

DESCRIPTION OF THE PREFERRED EMBODIMENTS

Figure 1:
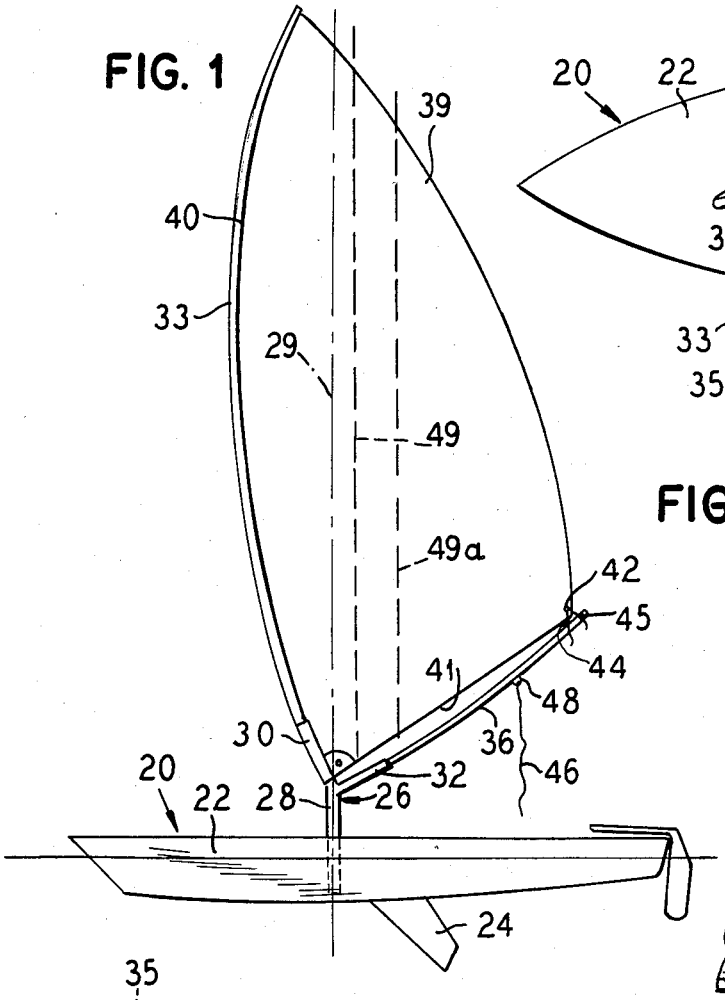
FIG. 1 is a side elevational view of a sailboat incorporating a rig embodying the principles of the present invention.
Figure 2:
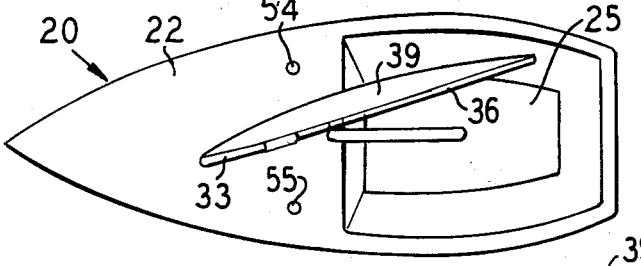
FIG. 2 is a plan view of the boat shown in FIG. 1.
Figure 4:
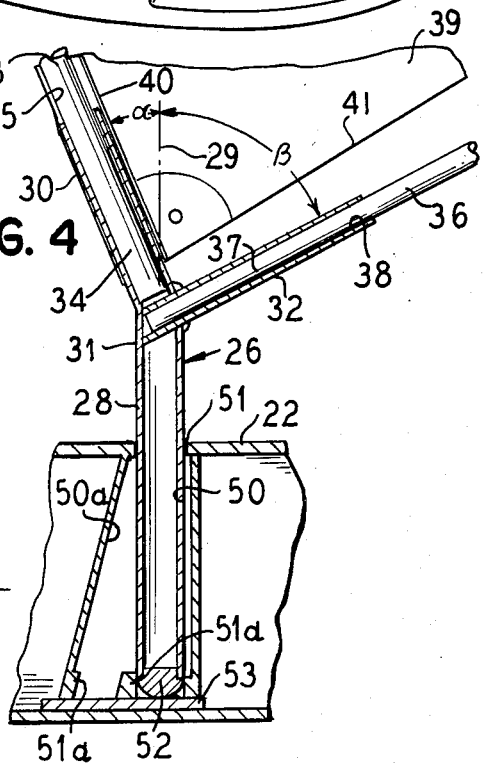
FIG. 4 is an enlarged partial view of the fabricated adapter.

In FIGS. 1 and 2 there is shown a wind powered vessel comprising a sailing vessel generally at 20 which comprises a hull 22 with a downwardly dependent centerboard 24 or daggerboard and a cockpit 25. Although a sailboat is shown, the invention can also be used in other wind powered vessels such as ice boats. A fabricated spar adapter 26, shown in detail in FIG. 4, is rotatably captured in a receptacle 27 in the hull 22 and is formed somewhat in the shape of a Y with a downwardly depending leg 28 which is received in the receptacle 27 and which has a center axis 29 about which the adapter rotates. A first arm 30 extends from a top end 31 of the leg 28, at an acute angle $\alpha$ from the leg the leg axis 29. The angle $\alpha$ is preferably in the range of 0°–20°. A second arm 32 extends from the top end 31 of the leg 28, at an angle $\beta$, greater than angle $\alpha$, from the leg axis 29, in the same plane as arm 30, but at an opposite side of the axis 29. The angle $\beta$ is preferably in the range of 55°–90°. The angle $\alpha+\beta$, between the two arms is preferably in the range of 60°–100°.

A rigid mast spar 33 is received at a first end or heel 34 in an open end 35 of the first arm 30 and a rigid boom spar 36 is received at a first end or heel 37 in an open end 38 of the second arm 32. A sail 39 is secured along a forward or luff edge 40 to the mast spar 33, and at a bottom or foot 41 edge is secured at a clew 42 by an appropriate line 44 to a tail 45 of the boom 36. A control sheet 46 is attached at 48 to the boom spar 36.

Because of the forward angle of the first arm 30 which receives the mast spar 33, the forward edge 41 of the sail 39 and a portion of the sail are held forward of the rotational axis 29 of the fabricated adapter 26. The airfoil center line of effort 49 of the sail is positioned very close to the rotational axis 29, unlike conventioal rigs where the center of effort is well away from the rotational axis. This close positioning reduces the required sheeting tension at control sheet 46 and renders the vessel essentially self tending. A projected centering line of the sail 49a is behind or downwind of the airfoil center line 49 when the sail 39 is set to a proper angle of incidence (preferably about 15°) to the apparent wind. Thus, if a gust of wind hits the sail more broadside than the apparent wind, the tension of control sheet 46 will hold the sail in place or if the sheet 46 is eased will prevent excessive lateral force.

Figure 3:
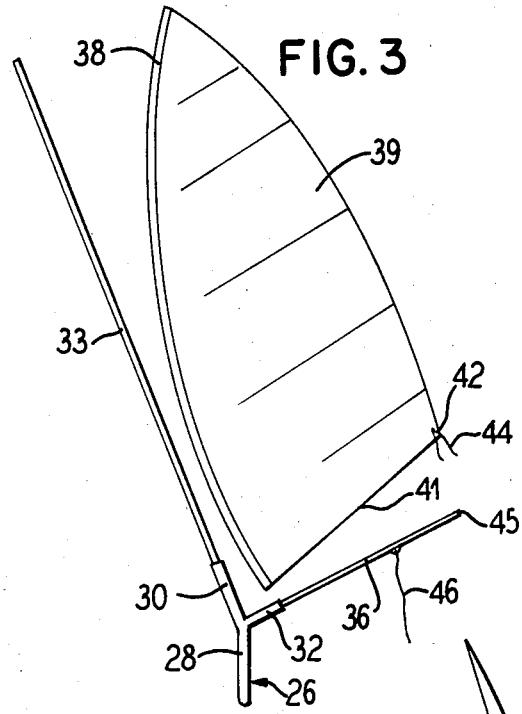
FIG. 3 is a side elevational view of the rig prior to attaching the sail.

As shown in FIG. 3, it is seen that the mast spar 33 and boom spar 36 are generally straight elongated members but when attached to the sail as shown in FIG. 1 they are bent from their natural straight position due to the configuration of the sail 39 in which the forward edge 41 is cut in a curved shape and the bottom edge or foot 41 is angled upwardly to the clew 42. The foot 41 need not be angled up so long as the clew 42 is positioned above the boom spar 36. The boom spar 36 and mast spar 33 are preferably made of a rigid but resilient material such as aluminum or fiberglass such that when the sail is secured to the mast and boom spars there will be a tension in the sail due to the spring-like resiliency of the mast and boom spars. The fabricated adapter 26 is preferably formed of a rigid light weight material such as aluminum which provides a rigid mounting base for the heel end of each of the boom and mast spars.

As shown in FIG. 4, the hull receptacle 27 may have two portions, a first portion 50 being substantially vertical and a second portion **50*a* being angled slightly rearwardly from vertical. Both portions 50, 50*a* have a top bearing 51 and a bottom bearhing 51*a* to engage the leg 28 firmly, yet to allow it to bend slightly between the bearings 51, 51*a* to distribute the stress throughout the leg within the receptacle. With the downward extending leg 28 in the first portion 50 of the receptacle, the sail 39 is in an "upright" position as shown in FIG. 1**. This is the position which would normally be used for general sailing purposes.

Figure 6:
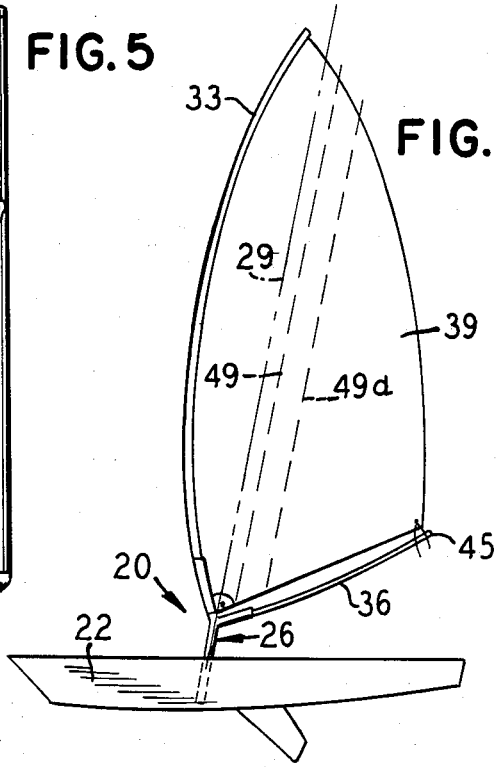
FIG. 6 is a side elevational view of a boat with a fabricated adapter in an alternate side position.

With the downward depending leg 28 in the second portion 50 of the receptacle 27, the sail 39 would be in a "rearward" position such as shown in FIG. 6 which would be more useful in heavy air situations.

Figure 5:
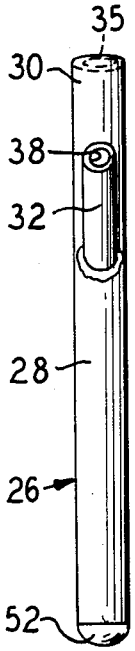
FIG. 5 is a rear elevational view of the fabricated adapter of FIG. 4.

FIG. 5 shows the mast adapter 26 illustrating that the first arm 30 and second arm 32 lie in the same plane. At a bottom end 52 at the leg 28, there is a rounded portion which seats on a plate 53 at the bottom of the receptacle 27 and acts as a bearing to assist in rotation of the adapter within the receptacle. In this manner, the adapter 26 is free to rotate about the axis 29 of the downward depending leg 28.

Figure 7:
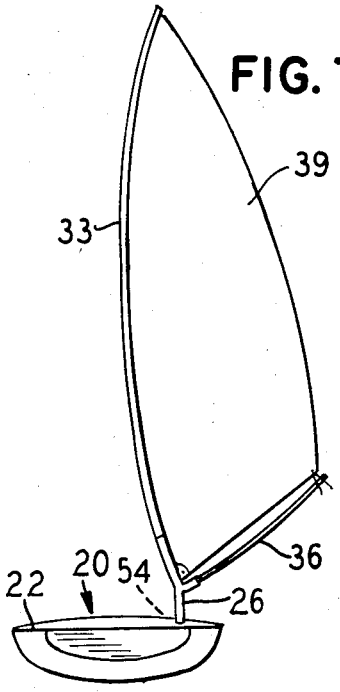
FIG. 7 is a rear elevational view of the boat of FIG. 6.

FIG. 7 is a rear view of the sailing vessel 20 in which the mast adapter 26 is placed into a right lateral receptacle 54 which can also be seen in FIG. 2. The receptacle 54 is substantially identical to receptacle 27 except that it is displaced laterally from the longitudinal centerline of the boat.

Figure 8:
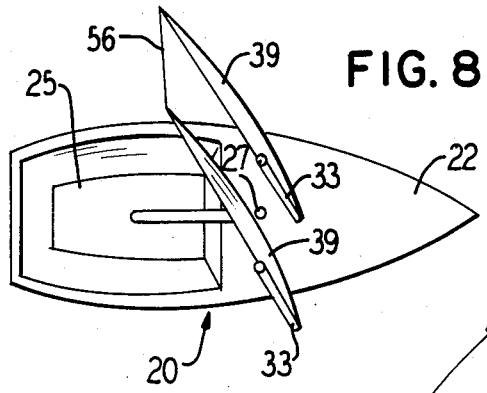
FIG. 8 is a plan view of a boat incorporating a double sail rig.
Figure 9:
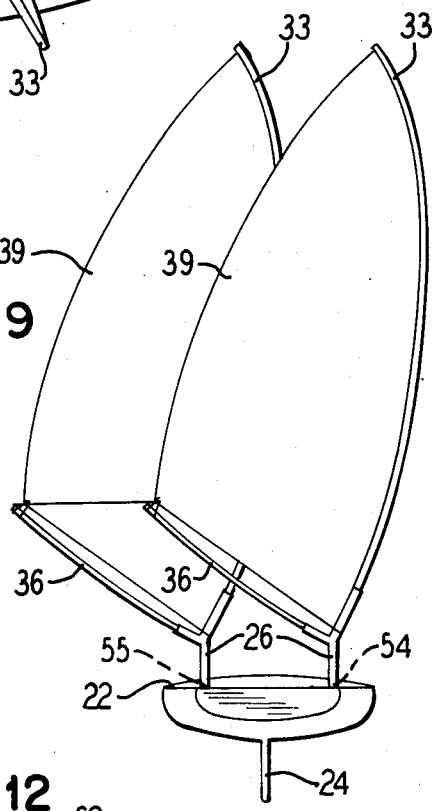
FIG. 9 is a rear elevational view of the boat of FIG. 8.

FIGS. 8 and 9 show a double rigged boat 20 in which two identical sails 39, 39 are used which are carried on adapters 26, 26 placed in laterally spaced receptacles 54, 55 to provide a double sail area. The tails 45, 45 of the boom spars 36, 36 can be sheeted together as illustrated at 56 to hold the sails in the desired alignment and to reduce the sheeting to the cockpit 25.

Figure 10:
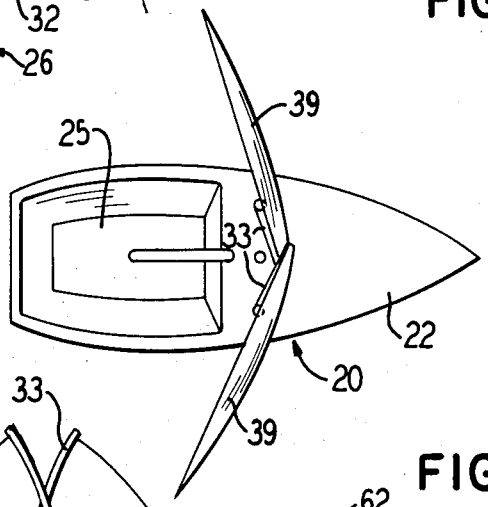
FIG. 10 is a plan view of a double sail rig in a running configuration.
Figure 11:
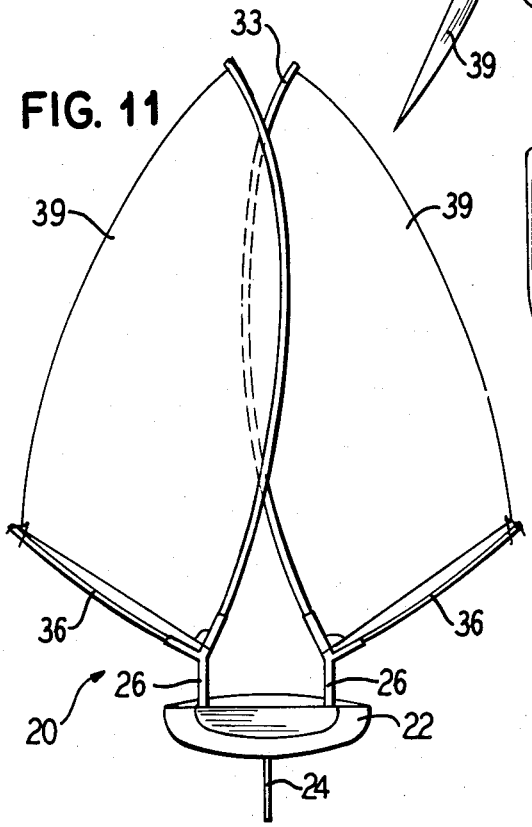
FIG. 11 is a rear elevational view of the boat shown in FIG. 10.

The double sails can be detached from one another so that they are separately movable and independently sheeted which permits the sails to be placed in opposite orientations when running downwind as is shown in FIGS. 10 and 11. In this configuration, nearly double the sail area will be presented.

Figure 12:
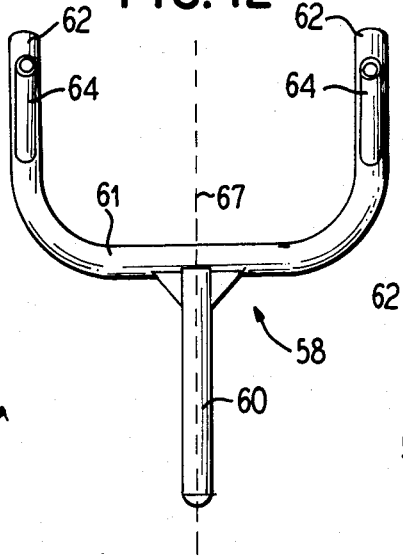
FIG. 12 is a rear elevational view of a double fabricated adapter.
Figure 13:
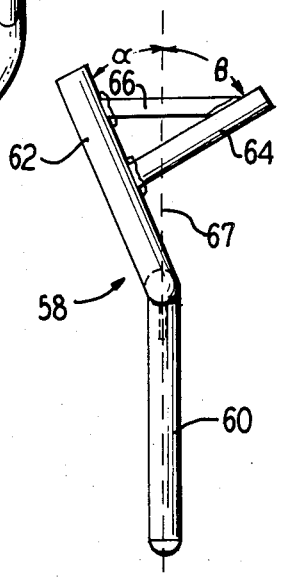
FIG. 13 is a side elevational view of the adapter of FIG. 12.
Figure 14:
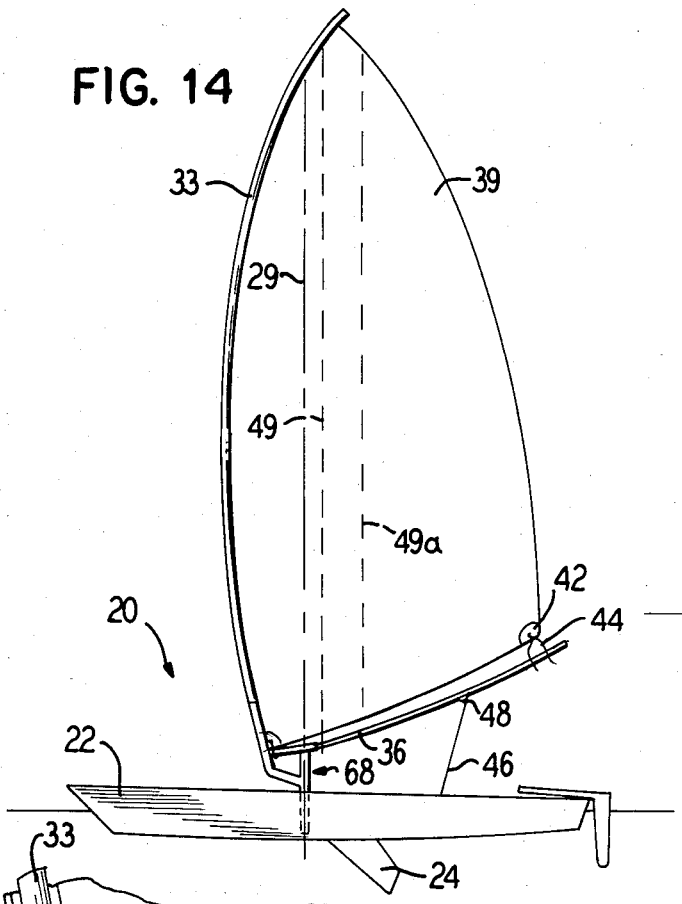
FIG. 14 is a side elevational view of a preferred embodiment of the present invention.

In FIGS. 12 and 13, an alternate construction of a fabricated adapter is shown generally at 58 in which there is a single downwardly depending leg 60, but two laterally spaced Y-shaped portions carried on a cross bar 61, each having a first upstanding arm 62 for receiving the mast spar heel and a second angled arm 64 for receiving the boom spar heel. A brace strut 66 interconnects the mast arm 62 to the boom arm 64 to increase the stability and durability of the fabricated adapter. The angles of the first arm 62 to the leg 60, the second arm 64 to the leg 60 and the arms to each other would fall within the same ranges described above relating to adapter 26. This adapter 58 can be used for double sail rigging without the need for two separate fabricated adapters or may be used with one sail only. All of the pivot action will occur about a substantially vertical axis 67 of the downwardly depending leg 60.

In FIGS. 14–18 there is shown a preferred construction and arrangement of a fabricated adapter 68 which has a first upstanding forward arm 70, a rearwardly extending arm 72 and a downwardly extending leg 74. The forward arm 70 connects to the downwardly extending leg 74 by an extension arm 76 which holds a lower end 77 of the upstanding arm 70 at a forwardly spaced distance from the downwardly extending leg 74. The rearwardly extending arm 72 is connected near a rear open end 78 to a top end 80 of the downwardly extending leg 74. The rearwardly extending arm 72 is connected at a forward end 82 to the upwardly extending arm 70 above the extension arm 76. Due to the interlocking bracing arrangement of the two arms and the leg, the adapter 68 is structurally stronger and more stable than the adapters 26, 58 shown in the previous figures. The angles of the forward arm 70 to the leg 74($\alpha$), the rearward arm 72 to the leg 74 ($\beta$), and the arms to each other ($\alpha$ & $\beta$) would also preferably fall within the ranges described above relating to adapter 26.

Figure 15:
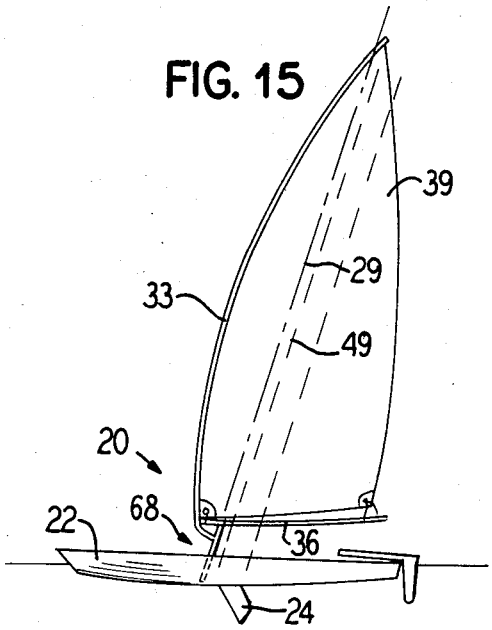
FIG. 15 is a side elevational view of the vessel shown in FIG. 14 with the fabricated adapter in an alternate position.
Figure 17:
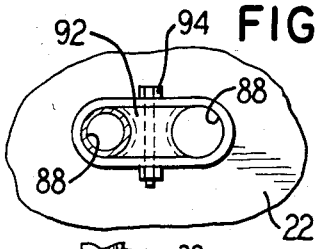
FIG. 17 is a top elevational view taken generally along the lines XVII—XVII of FIG. 16.
Figure 16:
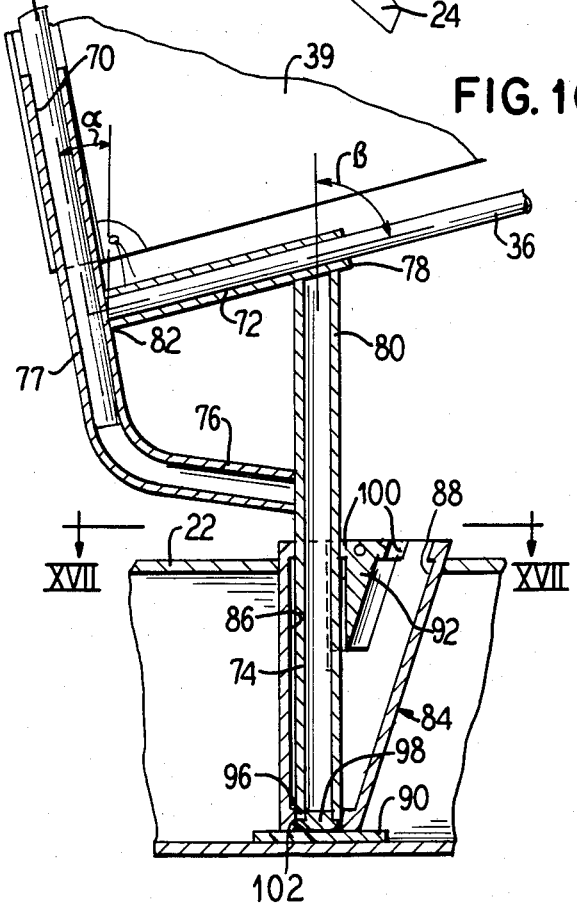
FIG. 16 is a side sectional view of the alternate arrangement of the fabricated adapter.
Figure 18:
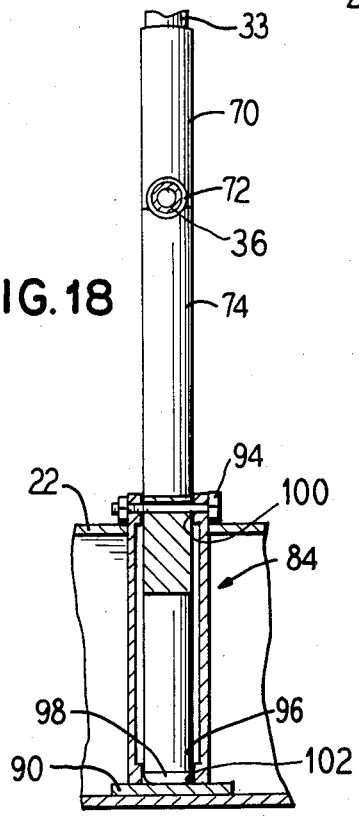
FIG. 18 is a rear elevational view of the fabricated adapter shown in FIG. 16.

A slightly varied receptacle 84 is illustrated in FIG. 16 which has a first substantially vertical passage 86 and a second, rearwardly angled passage 88 which join at a common base plate 90. By use of this receptacle 84, the leg 74 can be placed in a substantially vertical position shown in FIG. 14 for normal sailing conditions, or, the leg 74 can be placed in the rearward passage 88 to cause the sail to be held in a rearward position as shown in FIG. 15 for heavy wind sailing. The two separate passages 86, 88 in the receptacle 84 are defined by a central block 92 seen in FIGS. 16 and 17 which is held in place by an appropriate fastening means 94 such as a bolt. A bottom end 96 of the downwardly extending leg 74 has a rounded plug 98 therein which acts as a bearing against the plate 90 to assist in rotation of the adapter 68 within the receptacle 84. Again, top bearings 100 and a bottom bearing 102 are provided in the receptacle to engage the leg 74 and to distribute the stresses within the leg.

In each of the embodiments shown, the sail 39 has a curved forward or luff edge and when the sail is attached to the mast 33 and boom 36, the mast and boom spars are pulled towards each other by the sail but, due to their stiffness and resiliency, resist with a spring force creating a tension between mast and boom thereby providing a tension in the sail. With this rigging, there is no longer a need for a boom vang which is a sheeting arrangement used in some boats to hold the boom down in order to prevent slack in the sail. A boom vang normally would attach to the boom and a point near the base of the mast, and intrudes into the space of the cockpit.

Another advantage of the tensioned sail is a reduction in the twisting of the sail which occurs in varying degrees in conventional rigs. The twisting of the sail is caused by the force and angle of incidence at which the wind strikes the sail. Twisting reduces efficiency by changing the airfoil characteristics of the sail. Since the present ring retains the tension in the sail for all rotational positions of the fabricated adapter and the sheeting effort applied to the boom is reduces, twisting is effectively prevented. This benefit is enhanced by the airfoil effort being close to the center of rotation of the rig.

With the present rigging, since the lead edge of the sail is displaced forwardly of the center of rotation of the fabricated adapter, the center of effort of the rig is in proximity to the center of rotation of the rig. Although the center of effort is slightly behind the center of rotation, the two are very close in location and therefore the sheeting tension required to move the rig is substantially lessened over existing rigs. The projected centerline of the sail is slightly behind the center of rotation giving additional control to the person sailing the boat.

As is apparent from the foregoing specification, the invention is susceptible of being embodied with various alterations and modifications which may differ particularly from those that have been described in the preceeding specification and description. It should be understood that I wish to embody within the scope of the patent warranted hereon all such modifications as reasonably and properly come within the scope of my contribution to the art.

I claim as my invention:

1. In a sailing vessel having a hull, a sailing comprising:

a fabricated adapter having, a downwardly extending leg with a longitudinal axis;

a first arm rigidly connected to said leg by a forwardly extending, rigid extension arm, and being angled upwardly and forwardly at a first acute angle from said axis;

a second arm rigidly connected to said first arm and said leg and being angled rearwardly at a second angle from said axis greater than said first acute angle;

said first and second arm being coplanar with each other and being rigidly interconnected, but extending from opposite sides of said axis;

a rigid but resilient mast span securable to said first arm;

a rigid but resilient boom spar, shorter than said mast spar, securable to said second arm;

an asymmetrical sail having a convex curved lead edge attachable to said mast and a foot attachable to said boom;

at least one receptacle in said hull receiving said downwardly extending leg for rotation about said axis;

said sail having a center of effort downwind of said rotational axis when said sail is set to a proper angle of incidence to the apparent wind;

whereby, said sail is easily rotatable about said rotational axis.

2. A fabricated adapter for use in a wind powered vessel comprising:

a leg having a vertical axis and first and second ends;

a first arm with first and second ends;

an extension arm;

said first arm being rigidly connected at its first end by said extension arm to said leg between said first and second ends of said leg such that said first arm is spaced from said leg and is angled at a first acute angle from said axis, with its second end being free;

a second arm with first and second ends;

said second arm being rigidly attached at its first end to said first arm and rigidly attached to the first end of said leg between its first and second ends, with its second end being free;

said second arm being angled at a second angle from said axis greater than said first acute angle;

said first and second arms being coplanar with each other, but having their free ends on opposite sides of said axis.

3. A fabricated adapter according to claim 2, wherein said first acute angle is in the range of 0°–20°.

4. A fabricated adapter according to claim 2, wherein said second angle is in the range of 50°–90°.

5. A fabricated adapter according to claim 2, wherein the angle between said two arms, being the sum of said first and second angles, is in the range of 65°–100°.

6. A fabricated adapter according to claim 2, wherein said free ends of said first and second arms are open.

7. A fabricated adapter according to claim 2, wherein said first arm and said extension arm are formed of one piece of material and are connected by a bend in the material.

8. A rig for a sailing vessel comprising:

a fabricated adapter having:

a leg having a vertical axis and first and second ends;

a first arm with first and second ends;

an extension arm;

said first arm being rigidly connected at its first end by said extension arm to said leg between said first and second ends of said leg such that said firm arm is spaced from said leg and is angled at a first acute angle from said axis, with its second end being free;

a second arm with first and second ends rigidly attached at its first end to said first arm and rigidly attached to said first end of said leg between its first and second ends, with its second end being free;

said second arm being angled at a second angle from said axis greater than said first acute angle;

said first and second arms being coplanar with each other, but having their free ends on opposite sides of said axis;

a rigid but resilient mast spar securable to said second end of said first arm;

a rigid but resilient boom spar shorter than said mast spar, securable to said second end of said second arm;

a sail having a convex curved leading edge attachable to said mast spar and a foot attachable to said boom spar;

whereby, said mast spar and boom spar will be bowed and held under tension upon attachment of said sail to hold said sail in a taut condition.

9. A fabricated adapter according to claim 8, including two first arm and second arm pairs laterally spaced apart on a bar, each pair of arms having a mast spar and boom spar securable thereto.

10. A rig according to claim 8, wherein said arms are hollow tubular members and said mast spar and said boom spar are received in said arms.

11. A rig according to claim 8, wherein said lead edge of said sail has a passage therein for receiving said mast spar.

12. In a sailing vessel having a hull, a sail rig comprising:

a fabricated adapter having:

a leg having a vertical axis and first and second ends;

a first arm with first and second end;

an extension arm;

said first arm being rigidly connected at its first end by said extension arm to said leg between said first and second ends of said leg such that said firm arm is spaced from said leg and is angled at a first acute angle from said axis, with its second end being free;

a second arm with first and second ends;

said second arm being rigidly attached at its first end to said first arm and rigidly attached to said first end of said leg between its first and second ends with its second end being free;

said second arm being angled at a second angle from said axis greater than said first acute angle;

said first and second arms being coplanar with each other, but having their free ends on opposite sides of said axis;

a rigid but resilient mast spar securable to said second end of said first arm;

a rigid but resilient boom spar shorter than said mast spar, securable to said second end of said second arm;

a sail having a convex curved leading edge attachable to said mast spar and a foot attachable to said boom spar;

at least one receptacle in said hull receiving a second end of said leg for rotation about said axis;

said sail having a center of effort downwind of said rotational axis when said sail is set to a proper angle of incidence to the apparent wind;

whereby, said sail is easily rotatable about said rotational axis.

13. A vessel according to claim 12, wherein two fixed and rigid receptacles are provided, one oriented to hold said leg in a substantially vertical orientation and one to hold said leg in a fixed rearwardly angled orientation.

14. A sailing vessel according to claim 12 including at least two fixed and rigid receptacles in said hull receiving a second end of said leg for rotation about said axis, one receptacle oriented to hold said mast spar in a substantially vertical orientation and one receptacle to hold said mast spar in a fixed rearwardly angled orientation.

15. A sailing vessel according to claim 14, wherein said receptacles are each on a center line of said vessel.

* * * * *